US009429146B2

(12) United States Patent
Fong

(10) Patent No.: US 9,429,146 B2
(45) Date of Patent: Aug. 30, 2016

(54) PRESSURE INTENSIFIER

(71) Applicant: John J. Fong, Irvine, CA (US)

(72) Inventor: John J. Fong, Irvine, CA (US)

( * ) Notice: Subject to any disclaimer, the term of this patent is extended or adjusted under 35 U.S.C. 154(b) by 591 days.

(21) Appl. No.: 13/835,919

(22) Filed: Mar. 15, 2013

(65) Prior Publication Data

US 2013/0287615 A1 Oct. 31, 2013

Related U.S. Application Data

(60) Provisional application No. 61/638,379, filed on Apr. 25, 2012.

(51) Int. Cl.
*F04B 1/02* (2006.01)
*F04B 9/111* (2006.01)
*F04B 3/00* (2006.01)

(52) U.S. Cl.
CPC . *F04B 1/02* (2013.01); *F04B 3/00* (2013.01); *F04B 9/111* (2013.01)

(58) Field of Classification Search
CPC ..... F04B 1/02; F04B 3/00; F04B 9/111; F16J 9/12; F02F 3/20
USPC ..... 417/490, 509, 394, 225
See application file for complete search history.

(56) References Cited

U.S. PATENT DOCUMENTS

| | | | | |
|---|---|---|---|---|
| 4,540,349 | A * | 9/1985 | Du | 417/393 |
| 5,664,940 | A | 9/1997 | Du | |
| 7,175,395 | B1 | 2/2007 | Forest | |
| 7,980,270 | B2 * | 7/2011 | Bertsch | F04B 43/026 137/625.68 |
| 7,980,870 | B2 * | 7/2011 | Tung | G06K 13/08 439/159 |
| 2009/0220364 | A1 * | 9/2009 | Rigal et al. | 417/521 |
| 2014/0072454 | A1 * | 3/2014 | Roberts | F15B 3/00 417/53 |

FOREIGN PATENT DOCUMENTS

| | | | | |
|---|---|---|---|---|
| EP | 2447545 | A1 * | 5/2012 | F15B 3/00 |
| JP | 61-32801 | U * | 7/1984 | F15B 3/00 |
| JP | 8-144939 | A * | 11/1994 | F04B 9/08 |

* cited by examiner

*Primary Examiner* — Charles Freay
*Assistant Examiner* — Thomas Cash
(74) *Attorney, Agent, or Firm* — Stetina Brunda Garred and Brucker

(57) ABSTRACT

A pressure intensifier including reciprocating pistons located in respective piston chambers, and a valve mechanism which reciprocates corresponding to movement of the pistons. A pressurized fluid is received by the intensifier and is routed to the piston chambers via movement of the valve mechanism to drive the pistons for boosting pressure of an outgoing fluid. Thus, the pressure of the incoming fluid is used to boost the pressure of the outgoing fluid.

20 Claims, 13 Drawing Sheets

PRESSURE INTENSIFIER

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Technical Field of the Invention

The present invention relates generally to pumps and more particularly to a device configured to boost the pressure of incoming fluid, wherein the device is powered by a portion of the incoming fluid to boost the pressure of the outgoing fluid.

2. Description of the Related Art

Increased fluid pressure is desirable in many different applications. For instance, many devices are installed on the end of a garden hose for increasing the pressure of the outgoing water. In most instances, such devices merely streamline the outgoing fluid, which gives the user the sense the fluid pressure is more powerful, when in reality the pressure is not boosted/increased at all.

In order to truly increase the fluid pressure, pumps are typically used. Pumps are well known devices which typically use mechanical action to boost fluid pressure. Pumps generally require a power source for driving the mechanical action of the pump. For instance, many pumps are manually actuated to use energy expended by a user for driving the pump. Other pumps may be driven by other means, such as electricity, gas or wind power.

Although conventional pumps may be useful for boosting the pressure of a fluid, conventional pumps suffer from several deficiencies. One deficiency is that the pumps are complex devices which are costly to manufacture and operate. Furthermore, operation of the pump may have a detrimental effect on the environment, as the fuel used to power the pump may generate environmentally harmful emissions.

Therefore, there is a need in the art for an improved pressure boosting device that operates in a more cost effective manner and that is more environmentally friendly.

BRIEF SUMMARY OF THE INVENTION

According to one embodiment there is provided a fluid pressure intensifier configured for use with a pressurized fluid source. The fluid pressure intensifier includes a primary housing including a first chamber, a second chamber, an inlet, an outlet, and an exhaust. A primary inlet passageway extends between the inlet and the first and second chambers. An outlet passageway extends between the outlet and the first and second pump chambers. First and second pistons heads are coupled to each other and are disposed within and moveable within respective ones of the first and second chambers. The first piston head divides the first chamber into a first medial chamber and a first lateral chamber, while the second piston head divides the second chamber into a second medial chamber and a second lateral chamber. A valve housing is coupled to the primary housing and includes an inner valve chamber fluidly coupled to the inlet via a secondary inlet passageway. A valve member is disposed within the inner valve chamber and is transitional relative to the valve housing between a first position and a second position. In the first position the inlet is in fluid communication with the first lateral chamber via the inner valve chamber, the first medial chamber is in fluid communication with the outlet via the outlet passageway, the second medial chamber is in fluid communication with the inlet via the primary inlet passageway, and the exhaust is in fluid communication with the second lateral chamber via the inner valve chamber. In the second position, the inlet is in fluid communication with the second lateral chamber via the inner valve chamber, the second medial chamber is in fluid communication with the outlet via the outlet passageway, the first medial chamber is in fluid communication with the inlet via the primary inlet passageway, and the exhaust is in fluid communication with the first lateral chamber via the inner valve chamber.

The valve member may include a valve sleeve and a valve stem coaxially aligned with the valve sleeve and moveable relative thereto between a first stem position and a second stem position.

An over-center linkage may be coupled to the second piston head and the valve stem to correlate movement of the valve stem to movement of the piston heads. The over-center linkage may includes a slide body translatably coupled to valve stem and a spring element coupled to the second piston head.

The valve member may include an inner cylindrical portion defining an inner opening sized to receive the valve stem, and a plurality of annular ribs coupled to and extending radially outward from the inner cylindrical portion. The plurality of annular ribs may define a plurality of channels between adjacent ones of the plurality of rib. At least one of the channels may be in fluid communication with the secondary inlet passageway and an exhaust passageway.

The valve sleeve and the valve stem may collectively define a fluid connection passageway which moves relative to the valve housing as the valve sleeve moves between the first and second stem positions. When the valve stem is in the first stem position, the fluid connection passageway is in fluid communication with the first medial chamber and the exhaust, and when the valve stem is in the second stem position, the fluid connection passageway is in fluid communication with the inlet and the first medial chamber. When the valve stem is in the first stem position, the fluid connection passageway may be fluidly isolated from the inlet, and when the valve stem is in the second stem position, the fluid connection passageway may be fluidly isolated from the exhaust.

The primary housing may include an intermediate wall separating the first chamber from the second chamber. The intermediate wall may include an aperture formed therein. A connecting rod may extend through the aperture in the intermediate wall and may be connected to the first and second piston heads on opposed end portions thereof.

According to another embodiment, there is provided a pressure intensifier for use with a pressurized fluid source. The pressure intensifier includes a main body having first and second chambers disposed therein. First and second interconnected piston heads are disposed within respective ones of the first and second chambers, wherein the first piston head divides the first chamber into primary and secondary portions, and the second piston head divides the second chamber into primary and secondary portions. The first and second pistons heads are moveable relative to the main body between first and second piston positions. An inlet valve is connected to the main body and is fluidly connectable with the pressurized fluid source and transitional between first and second inlet configurations for alternately pressurizing the primary portions of the first and second chambers with fluid from the pressurized fluid source. A primary valve member is connected to the main body and is fluidly connectable with the pressurized fluid source and moveable relative to the main body between first and second valve positions for alternately pressurizing one of the secondary portions of the first and second chambers with fluid from the pressurized fluid source, and venting fluid from the other one of the secondary portions of the first and second chambers. An outlet valve member is coupled to the main body and moveable between first and second outlet configurations for alternately venting fluid from the primary portions of the first and second chambers. When the first and second piston heads are in the first position, the inlet valve member is in the first inlet configuration to allow fluid to flow into the primary portion of the first chamber with fluid from the pressurized fluid source, the primary valve member is in the first position to vent fluid from the secondary portion of the first chamber and to direct fluid into the secondary portion of the second chamber, and the outlet valve member is in the first outlet configuration to vent fluid from the primary portion of the second chamber. When the first and second piston heads are in the second position, the inlet valve member is in the second inlet configuration to allow fluid to flow into the primary portion of the second chamber with fluid from the pressurized fluid source, the primary valve member is in the second position to vent fluid from the secondary portion of the second chamber and to direct fluid from the pressurized fluid source into the secondary portion of the first chamber, and the outlet valve member is in the second outlet configuration to vent fluid from the primary portion of the first chamber.

According to another aspect of the present invention, there is provided a fluid pressure intensifier comprising a housing having an inlet, an outlet, an exhaust, and a first and second piston chambers each being fluidly connectable to the inlet, the outlet and the exhaust. A first piston head and a second piston head are coupled to each other and are disposed within respective ones of the first and second piston chambers and moveable relative to the housing between a first piston position and a second piston position. The first piston head divides the first piston chamber into a first medial chamber and a first lateral chamber, while the second piston head divides the second piston chamber into a second medial chamber and a second lateral chamber. A valve housing defining a valve chamber is fluidly coupled to the inlet, the exhaust and the first and second piston chambers. A valve member is coupled to the housing and is fluidly connected to the inlet, the outlet and the exhaust. The valve member is moveable relative to the housing between a first valve position and a second valve position. When the valve member is in the first valve position, the inlet is fluidly connected to the second lateral chamber via the valve chamber and the first lateral chamber is fluidly connected to the exhaust via the valve chamber, the inlet is fluidly connected to the first medial chamber and the second medial chamber is fluidly connected to the outlet. When the valve member is in the second valve position, the inlet is fluidly connected to the first lateral chamber via the valve chamber and the second lateral chamber is fluidly connected to the exhaust via the valve chamber, the inlet is fluidly connected to the second medial chamber and the first medial chamber is fluidly connected to the outlet.

The present invention is best understood by reference to the following detailed description when read in conjunction with the accompanying drawings.

BRIEF DESCRIPTION OF THE DRAWINGS

These as well as other features of the present invention will become more apparent upon reference to the drawings wherein.

Common reference numerals are used throughout the drawings and detailed description to indicate like elements.

DETAILED DESCRIPTION OF THE INVENTION

Figure 1:
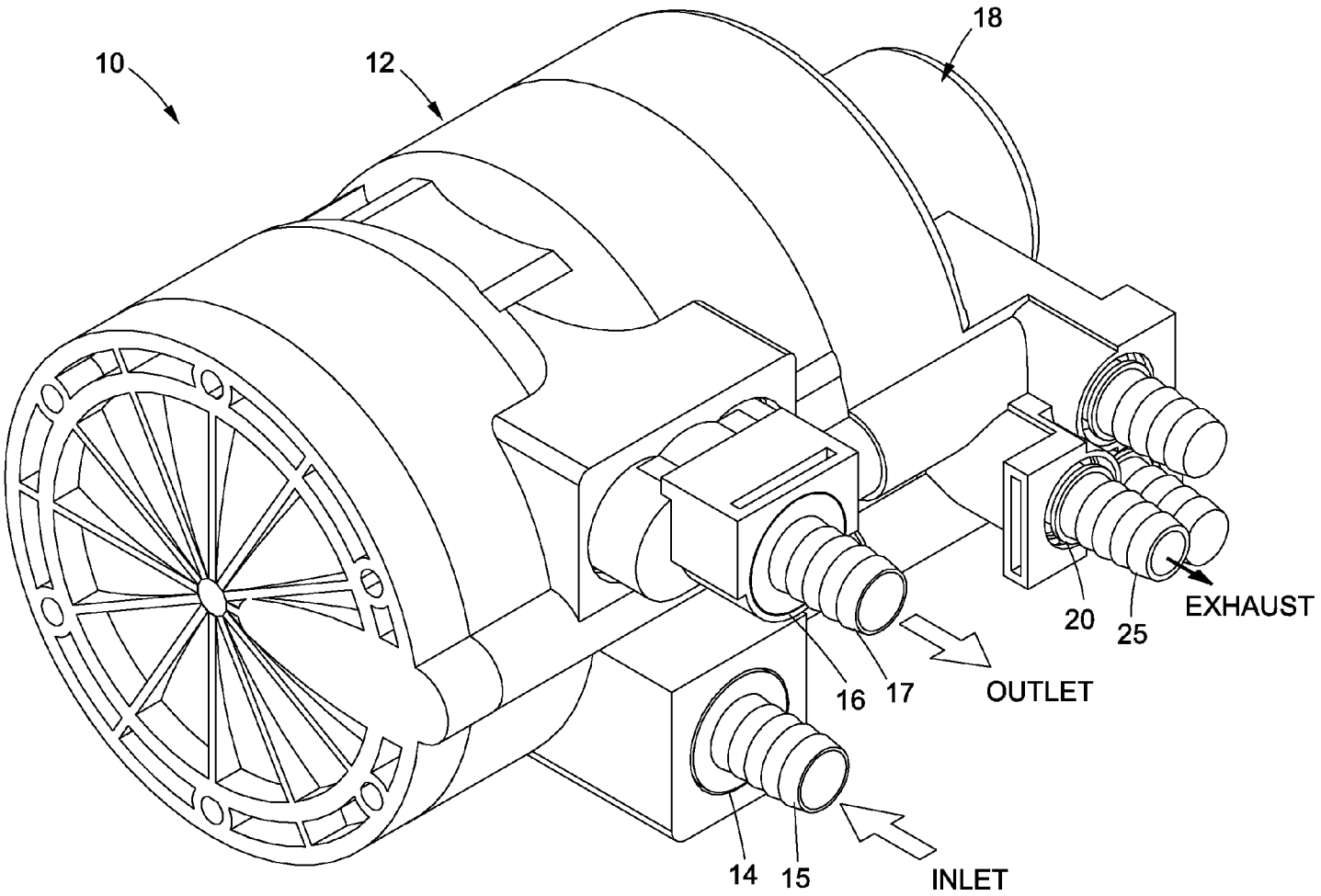
FIG. 1 is an upper perspective view of a fluid pressure intensifier constructed in accordance with an embodiment of the present invention.

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Referring now to the drawings, wherein the showings are for purposes of illustrating a preferred embodiment of the present invention only, and are not for purposes of limiting the same, there is depicted a fluid pressure intensifier 10 that is configured for use with a pressurized fluid. The pressure intensifier 10 is specifically adapted to utilize the pressure from the pressurized fluid to amplify or increase the pressure of outgoing fluid (e.g., fluid that exits the pressure intensifier via a pressurized outlet). In this regard, the pressurized fluid drives a pumping mechanism internal to the pressure intensifier to increase the pressure of fluid that exits the pressure intensifier 10.

The pressure intensifier 10 includes a pump housing 12 having an inlet 14 and an outlet 16. The inlet 14 is coupled to an inlet fitting 15 and the outlet 16 is coupled to an outlet fitting 17. A valve housing 18 is connected to the pump housing 12 and includes an internal valve mechanism which communicates with an exhaust 20. Pressurized fluid at a first pressure is introduced into the pressure intensifier 10 through the inlet 14 and the fluid is discharged through the outlet 16 at a second pressure that is greater than the first pressure. Non-pressurized fluid is discharged from pressure intensifier 10 through the exhaust 20, which may be connected to an exhaust fitting 25.

Figure 6:
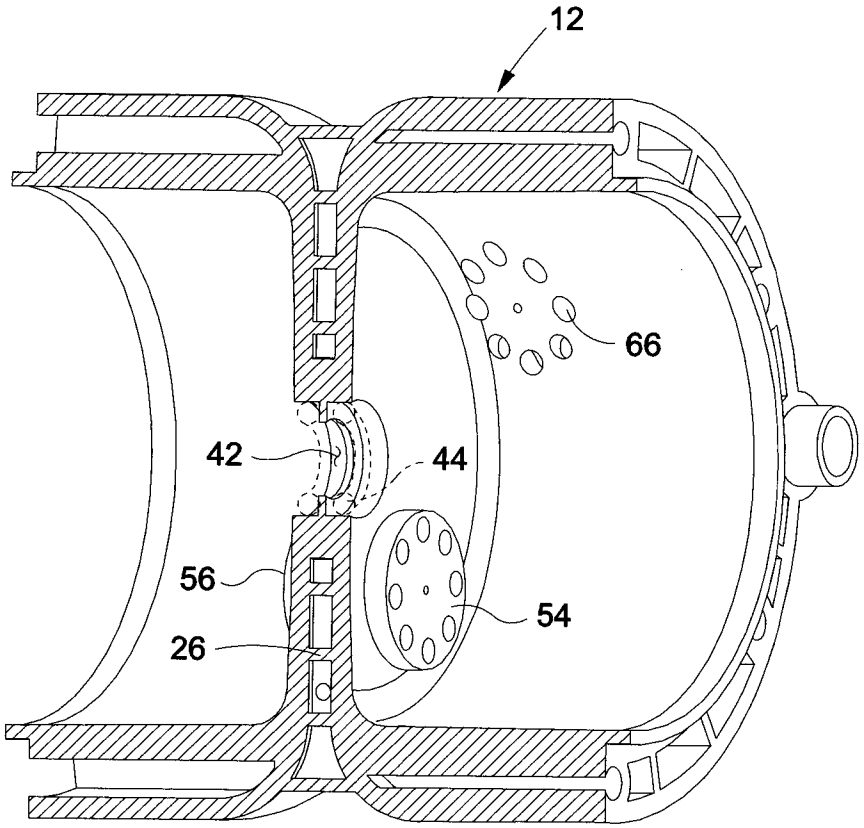
FIG. 6 is a perspective sectional view of the pump housing depicted in FIG. 5.

The pump housing 12 defines first and second internal chambers 22, 24, which are separated by an intermediate wall 26 (see FIG. 6). In the exemplary embodiment, the chambers 22, 24 are cylindrical in shape and are co-axially aligned with each other. First and second piston heads 28, 30 reside within the first and second internal pumping chambers 22, 24, respectively. The piston heads 28, 30 define a shape that is complimentary to the shape of the pumping chambers 22, 24. In the exemplary embodiment, the piston heads 28, 30 define a cylindrical configuration having an outer diameter that is complimentary in shape to the diameter defined by the walls of the cylindrically shaped pumping chambers 22, 24. Sealing members 35, 37, e.g., o-rings, are used to form a fluid tight seal between the piston heads 28, 30 and the walls which define the chambers 22, 24.

Each piston head 28, 30 divides the respective chamber 22, 24 into a medial portion and a lateral portion. In particular, the first piston head 28 divides the first chamber 22 into a first medial chamber 32 and a first lateral chamber 34, and the second piston head 30 divides the second chamber 24 into a second medial chamber 36 and a second lateral chamber 38.

Figure 3:
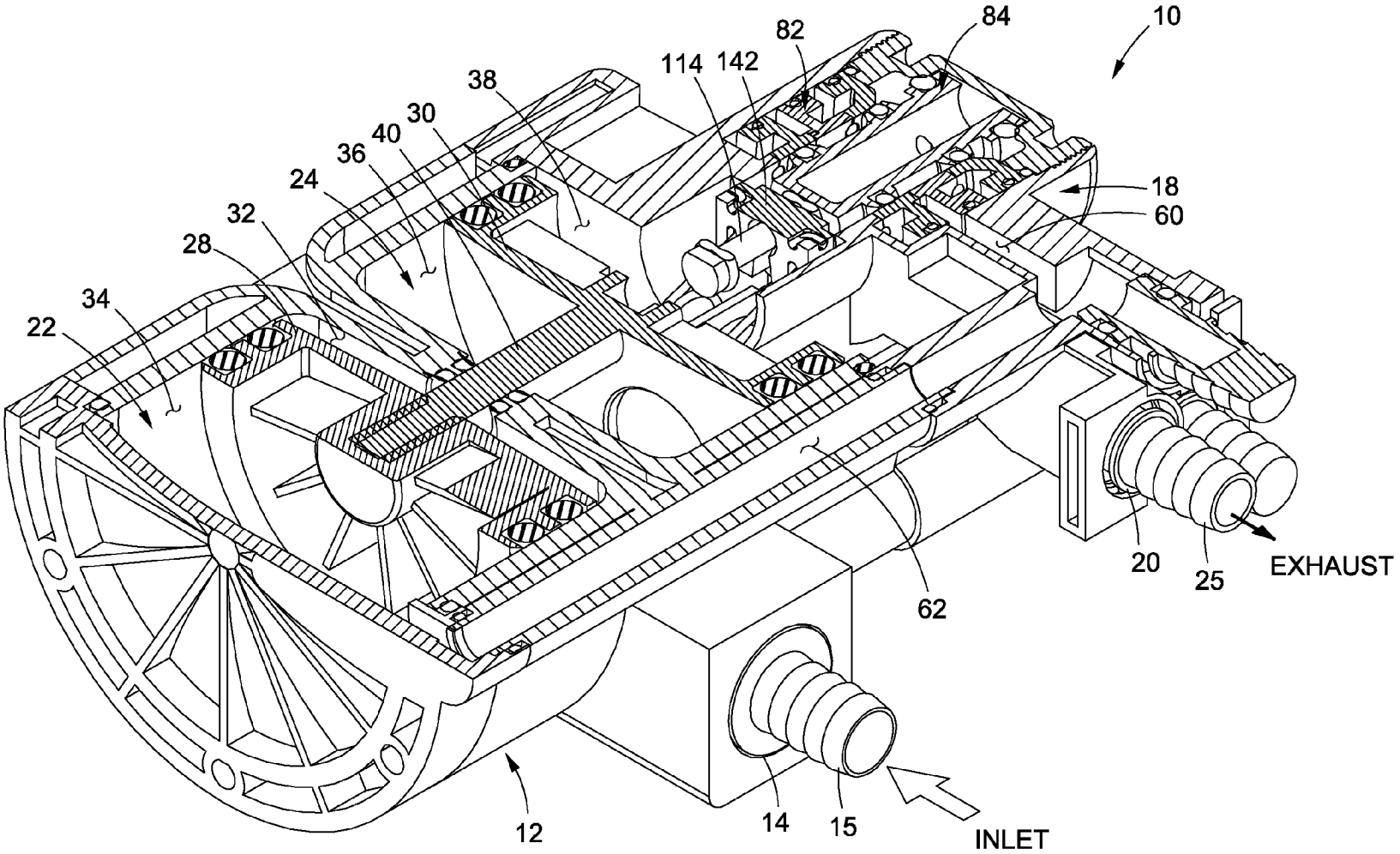
FIG. 3 is a perspective sectional view of the pressure intensifier taken along a second cross-sectional plane.

The piston heads 28, 30 are connected to each other via a connecting rod 40 (see FIG. 3). The connecting rod 40 extends through an aperture 42 (see FIG. 6) formed within the intermediate wall 26 and is connected to the first piston head 28 adjacent a first end portion of the rod 40 and the second piston head 30 adjacent a second end portion of the rod 40. Given the interconnection of the first piston head 28 to the second piston head 30 via the connecting rod 40, movement of the piston heads 28, 30 is synchronized. In other words, the first piston head 28 moves in the same direction and at the same speed as the second piston head 30. As will be described in more detail below, the piston heads 28, 30 reciprocate between first and second piston positions relative to the pump housing 12 to pressurize fluid located within the first and second medial chambers 32, 36.

An intermediate sealing element 44 (see FIG. 6) is disposed within the aperture 42 and provides a seal around the rod 40, while still allowing the rod 40 to translate within the aperture 42. The sealing element 44 is intended to prevent fluid migration between the first and second chambers 22, 24 through the aperture 42. In one embodiment, the intermediate sealing element may include a rubber gasket or a series of o-rings disposed about the rod 40.

A valve housing 18 is coupled to the pump housing 12 and defines an internal valve chamber 46. In the exemplary embodiment, the valve housing 18 mates with the pump housing 12 and a sealing element may be used to create a fluid tight seal between the pump housing 12 and the valve housing 18.

Figure 2:
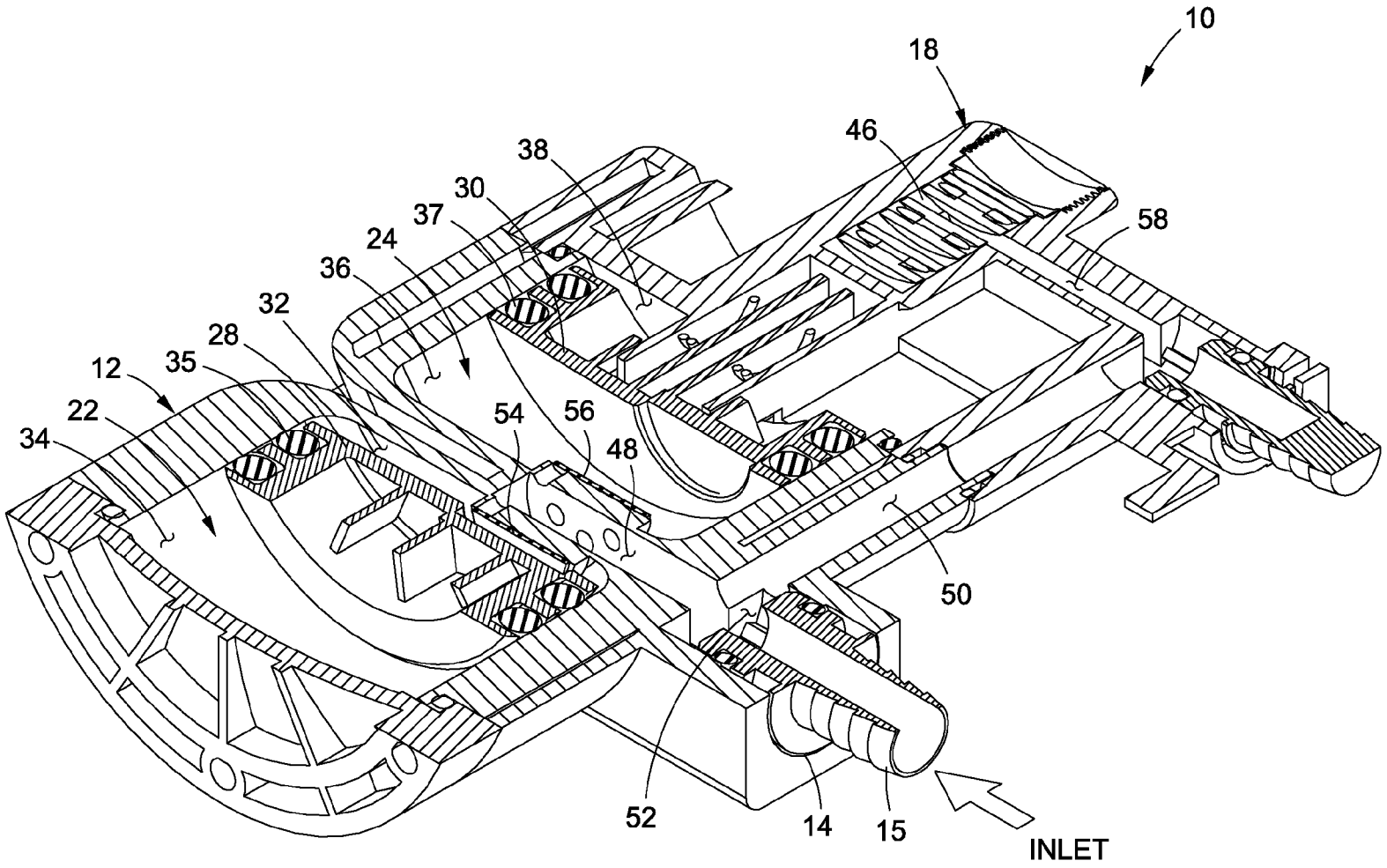
FIG. 2 is a perspective sectional view of the pressure intensifier taken along a first cross-sectional plane.

Several of the Figures show various cross sectional views taken along different cross-sectional planes to illustrate various aspects of the pump housing 12 and the internal components. Referring now specifically to FIG. 2, there is shown a cross-sectional view of the pressure intensifier 10 taken in a first cross sectional plane to highlight inlet passageways formed within the pump housing 12 through which fluid flows when it is received at the inlet 14. In particular, the pump housing 12 includes two internal inlet passageways in fluid communication with the inlet 14, namely a primary inlet passageway 48 and a secondary inlet passageway 50. The primary and secondary inlet passageways 48, 50 intersect at an inlet junction 52 wherein the inlet fluid is divided such that a portion of the inlet fluid travels through the primary inlet passageway 48 and the remaining portion of the inlet fluid travels through the secondary inlet passageway 50. Preferably, substantially half of the inlet fluid travels through the primary inlet passageway 48, while the remaining half travels through the secondary inlet passageway 50.

The primary inlet passageway 48 extends between the inlet 14 and the first and second internal pumping chambers 22, 24, and more specifically, the first and second medial chambers 32, 36 thereof. A first inlet valve 54 controls fluid flow from the primary inlet passageway 48 to the first medial chamber 32 of the first pumping chamber 22, and a second inlet valve 56 controls fluid flow from the primary inlet passageway 48 to the second medial chamber 36 of the second pumping chamber 24. Under normal operating conditions, when the first inlet valve 54 is open, the second inlet valve 56 is closed, and when the first inlet valve 54 is closed, the second inlet valve 56 is open. In this regard, fluid flowing through the primary inlet passageway 48 typically flows through whichever one of the first and second inlet valves 54, 56 is open.

According to one embodiment, the first and second inlet valves 54, 56 include disc-shaped bodies that move relative to first and second inlet valve openings, such that the valve bodies are moved away from the respective valve openings when the valves 54, 56 are in the open position to allow fluid to flow through the valves 54, 56. In the closed position, the valve bodies are seated against the valve openings to cover the valve openings and prevent fluid from flowing through the valves 54, 56.

The secondary inlet passageway 50 extends from the inlet junction 52 to a valve inlet passageway 58, which communicates with the internal valve chamber 46. Thus, fluid diverted into the secondary inlet passageway 50 is delivered to the internal valve chamber 46 by way of the valve inlet passageway 58.

Referring now specifically to FIG. 3, there is shown a cross-sectional view of the pressure intensifier 10, wherein the cross section is taken within a second cross sectional plane to depict a first valve outlet passageway 60 and an internal delivery passageway 62 extending from the internal valve chamber 46 to the first lateral chamber 34 of the first pumping chamber 22. In this regard, fluid may be delivered from the internal valve chamber 46 to the first pumping chamber 22 via the first valve outlet passageway 60 and the delivery passageway 62.

Figure 4:
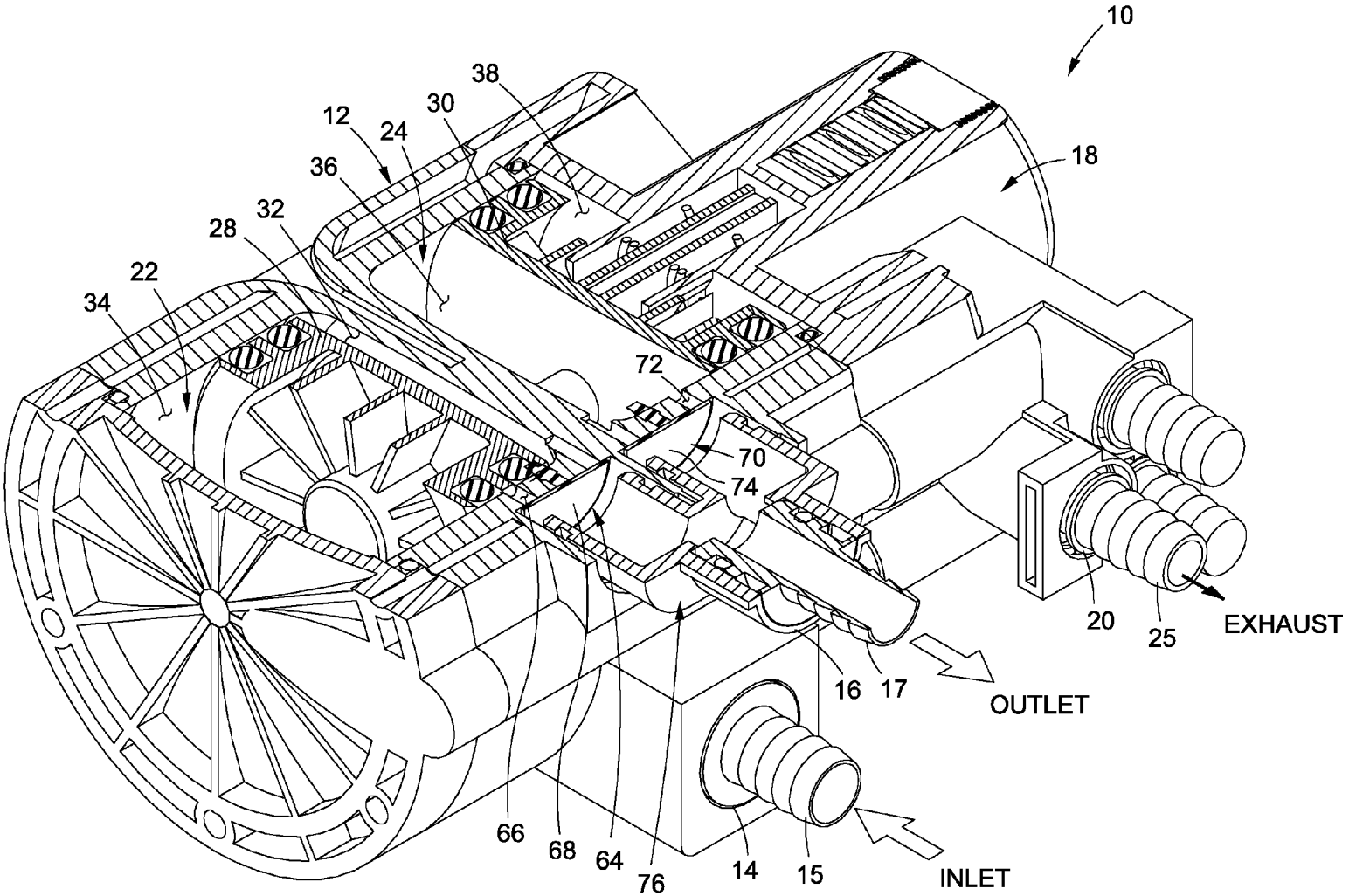
FIG. 4 is a perspective sectional view of the pressure intensifier taken along a third cross-sectional plane.

Referring now specifically to FIG. 4, there is shown a cross-sectional view of the pressure intensifier 10, wherein the cross section is taken in a third cross sectional plane to highlight the fluid communication between the outlet 16 and the first and second chambers 22, 24. In particular, the first chamber 22 includes a first outlet valve 64 including one or more first outlet openings 66 and a first outlet valve body 68 that is moveable relative to the openings 66 between closed and open positions. Similarly, the second chamber 24 includes a second outlet valve 70 including one or more second outlet openings 72 and a second outlet valve body 74 that is moveable relative to the openings 72 between closed and open positions. The first and second outlet valves 64, 70 are in fluid communication with each other via an outlet manifold 76, which includes the outlet opening 16 which communicates with an outlet fitting 17.

During routine operation of the pressure intensifier 10, the first and second outlet valves 64, 70 preferably operate oppositely to each other. In other words, when the first outlet valve 64 is open (e.g., the first outlet valve body 68 is spaced from the first outlet openings 66), the second outlet valve 70 is closed (e.g., the second outlet valve body 74 is seated against the second outlet openings 72). Conversely, when the second outlet valve 70 is open (e.g., the second outlet valve body 74 is spaced from the second outlet openings 72), the first outlet valve 64 is closed (e.g., the first outlet valve body 68 is seated against the first outlet openings 66).

Figure 5:
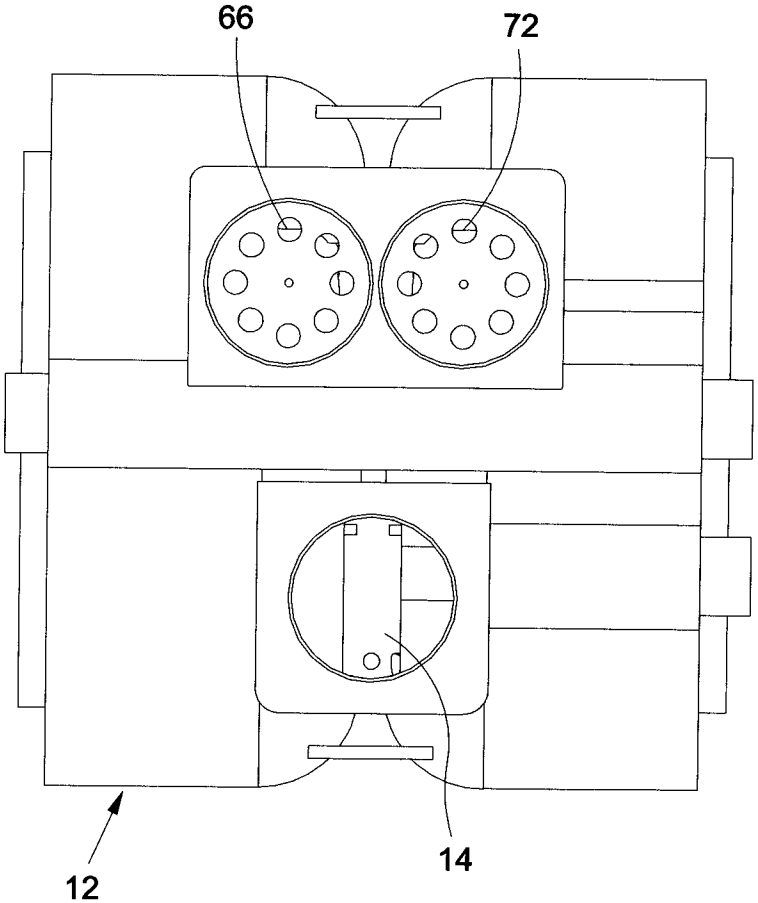
FIG. 5 is a side view of the pump housing.

FIG. 5 is a side view of the pump housing 12 showing the inlet 14 and the first and second outlet openings 66, 72. FIG. 6 is a perspective cross sectional view showing the first and second inlet valves 54, 56 and the first outlet openings 66.

Figure 7:
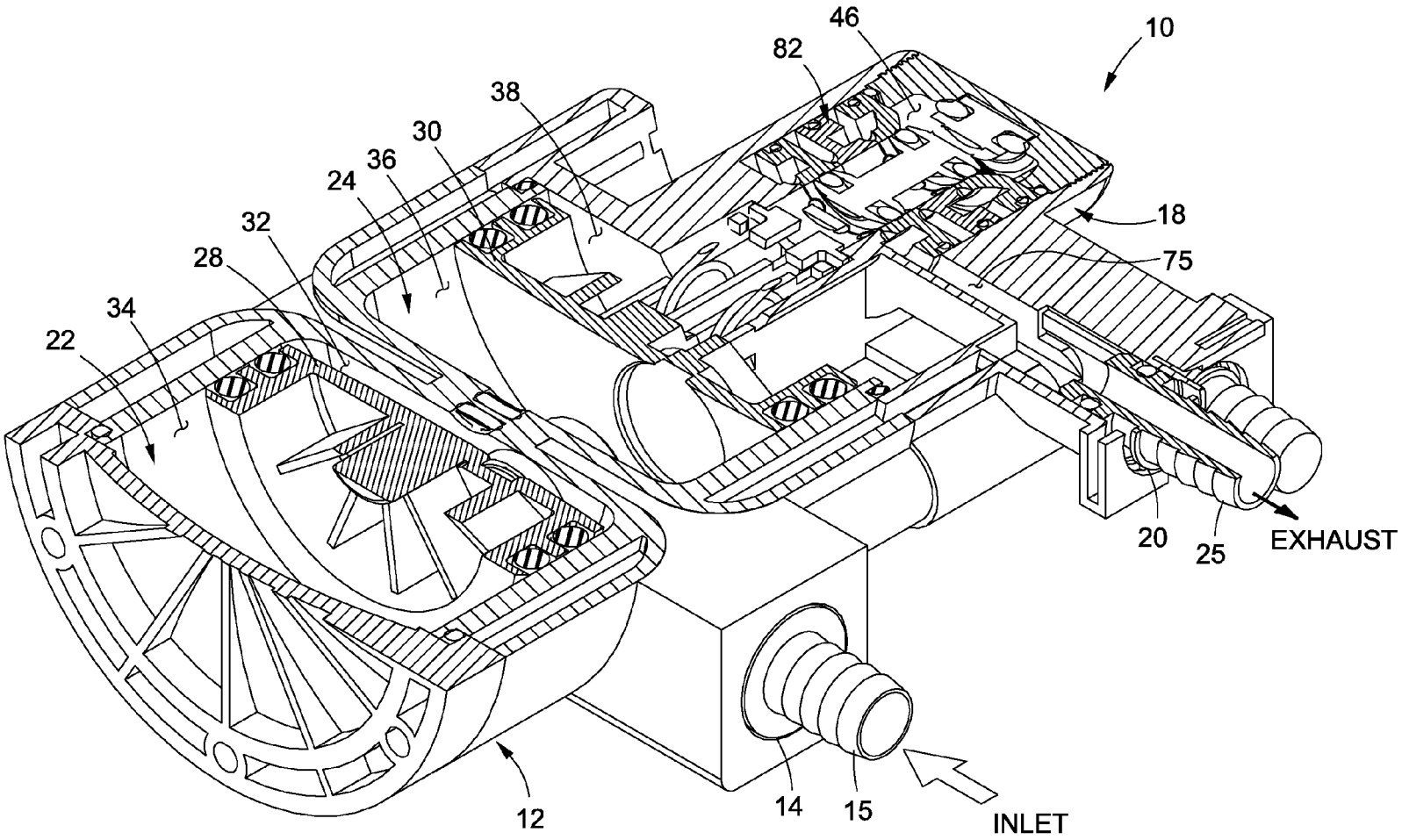
FIG. 7 is a perspective sectional view of the pressure intensifier taken along a fourth cross-sectional plane.

Referring now specifically to FIG. 7, there is shown a cross-sectional view of the pressure intensifier 10, wherein the cross section is taken in a fourth cross sectional plane to highlight a valve exhaust passageway 75 that extends from the internal valve chamber 46 to the exhaust 20. As will be explained in more detail below, fluid exiting the exhaust 20 is different from the fluid exiting the outlet 16. In particular, fluid exiting the outlet 16 has been pressurized to a pressure that is greater than the inlet pressure. Conversely, fluid exiting the exhaust 20 is not at an elevated pressure.

Figure 9:
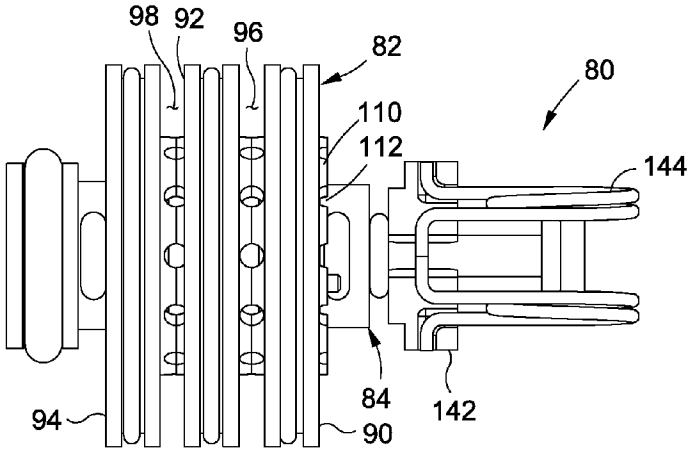
FIG. 9 is a top view of the valve assembly depicted in FIG. 8.
Figure 10:
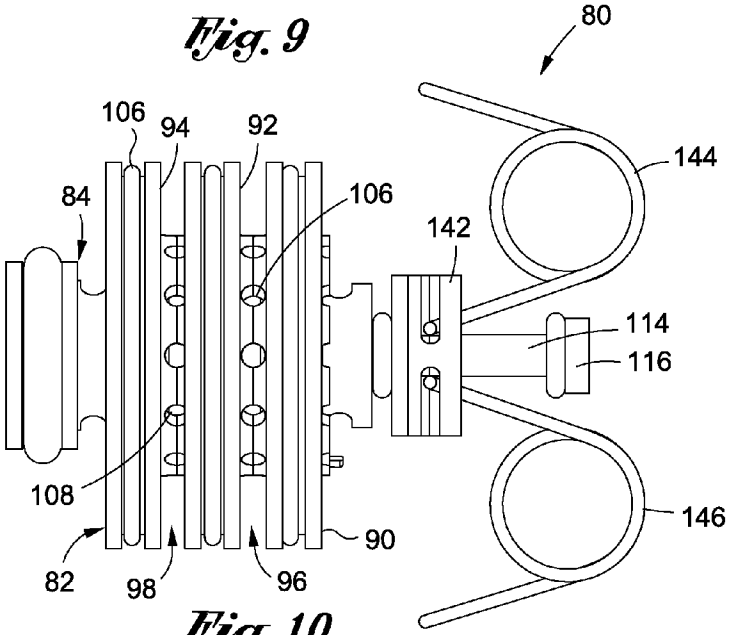
FIG. 10 is a side view of the valve assembly depicted in FIGS. 8-9.
Figure 8:
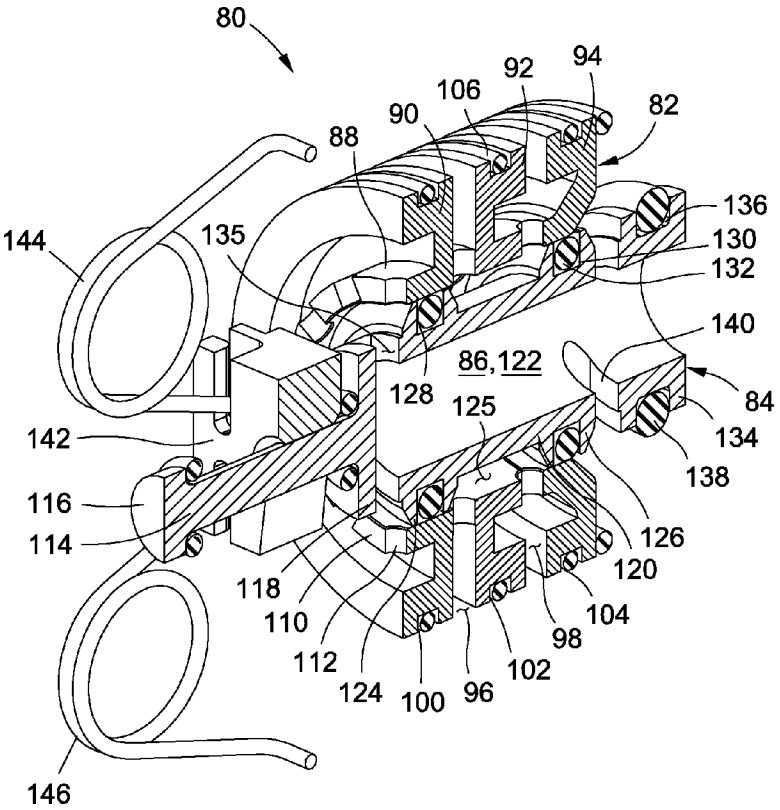
FIG. 8 is a perspective sectional view of a valve assembly.

Referring now to FIGS. 8-10, there is depicted a valve assembly 80 used to control fluid flow within the internal valve chamber 46. The valve assembly 80 includes an annular valve sleeve 82 and a valve stem 84 disposed within a central opening 86 formed with the valve sleeve 82 wherein the valve stem 84 is translatable relative to the valve sleeve 82, as will be described in more detail below.

The exemplary valve sleeve 82 includes an inner cylindrical portion 88 and three annular ribs 90, 92, 96 extending radially outward from the inner cylindrical portion 88 in spaced relation to each other to define a pair of annular channels 96, 98 between adjacent ribs. In particular, a first annular channel 96 is formed between a first rib 90 and a second rib 92, and a second annular channel 98 is formed between the second rib 92 and a third rib 94. The radial end portion of each rib 90, 92, 94 includes a respective cutout 100, 102, 104 formed therein that is sized and configured to receive a sealing member 106, e.g., an o-ring, for creating a fluid tight seal between the valve sleeve 82 and the valve housing 18 such that the first and second annular channels 96, 98 define separate flow passages, as will be described in more detail below.

The inner cylindrical portion 88 includes a plurality of first channel apertures 106 disposed in a radial pattern and in fluid communication with the first annular channel 96 and a plurality of second channel apertures 108 disposed in a radial pattern and in fluid communication with the second annular channel 98. A first end portion 110 of the inner cylindrical portion 88 defines a plurality of cutouts 112 positioned in a radial pattern which are configured to allow fluid to flow therethrough, as will be described in more detail below.

Figure 11:
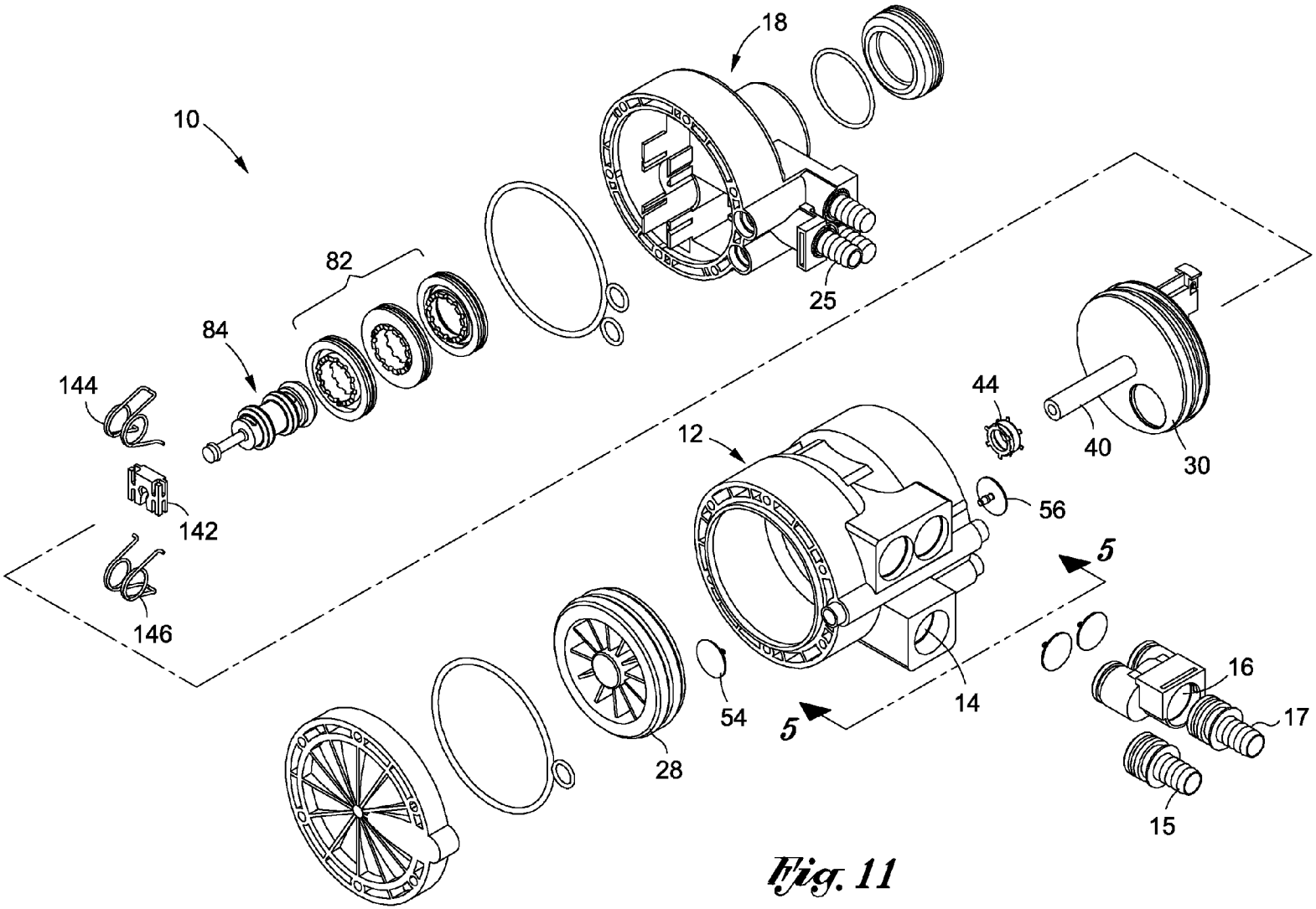
FIG. 11 is an exploded perspective view of the pressure intensifier.

According to one embodiment, the valve sleeve 82 is formed from three sub-elements, wherein each sub-element defines a respective one of the annular ribs 90, 92, 96, as shown in the exploded view depicted in FIG. 11.

The exemplary valve stem 84 includes a stem neck 114 having an enlarged first end portion 116 and an opposed, enlarged second end portion 118. The second end portion 118 is connected to a cylindrical stem body 120 which defines an inner stem opening 122. A pair of annular stem ribs 124, 126 extend radially outward from the cylindrical stem body 120 and each stem rib 124, 126 includes an annular cutout 128, 130 configured to receive a sealing member 132, e.g., an o-ring, for creating a fluid tight seal between the valve stem 84 and the valve sleeve 82.

The valve sleeve 82 and valve stem 84 collectively define a moveable fluid coupling segment 125 which is defined by the inner surface of the inner cylindrical portion 88, the first and second ribs 124, 126 and the outer surface of the stem body 120 extending between the first and second ribs 124, 126. In the embodiment depicted in FIG. 8, the fluid coupling segment 125 extends between, and is in fluid communication with, the first annular channel 96 and the second annular channel 98, which will be described below as the second stem position. The valve stem 84 is moveable to a first stem position, wherein the fluid coupling segment 125 is moved such that the first and second annular channels 96, 98 are not in fluid communication with each other.

The valve stem 84 further includes an annular end protrusion 134 disposed adjacent an end portion of the stem body 120 opposite the stem neck 114. The end protrusion 134 also includes a cutout 136 formed to receive a sealing member 138.

A first valve stem cutout 135 is formed on the valve stem 84 between the second end portion 118 of the neck 114, and the first stem rib 124. The first valve stem cutout 135 is in fluid communication with the inner stem opening 122. A second valve stem cutout 140 is formed between the end protrusion 134 and the adjacent one of the pair of stem ribs 126 and is in fluid communication with the inner stem opening 122.

A slide body 142 is coupled to the stem neck 114 and translates along the stem neck 114 between the first and second end portions 116, 118 thereof. The slide body 142 is coupled to a pair of spring elements 144, 146, which are also engaged with the second piston head 30. As will be described in more detail below, the movement of the second piston head 30 energizes the springs elements 144, 146, which causes the slide body 142 to translate along the stem neck 114, which in turn, causes the valve stem 84 to translate relative to the valve sleeve 82.

With the basic structural features of the pressure intensifier 10 described above, the following discussion will focus on operation of the pressure intensifier 10. During operation of the pressure intensifier 10, the piston heads 28, 30 transition between first and second piston positions, and the valve stem 84 transitions between first and second stem positions. As the piston heads 28, 30 and valve stem 84 reciprocate between their respective first and second positions, the fluid pressure of the fluid received at the pump housing 12 and discharged through the outlet 16 is increased. In particular, the pressure is increased within the medial chamber that is compressed by the movement of the piston heads 28, 30. The force driving the piston heads 28, 30 is provided by the pressurized fluid entering the expanding medial chamber portion via the respective inlet valve 54, 56, as well as the pressure in the fluid entering the expanding lateral chamber portion. The expanding medial chamber portion and expanding lateral chamber portions will be located in separate ones of the first and second internal pump chambers 22, 24, and will vary depending on the direction of movement of the piston heads 28, 30.

Figure 12:
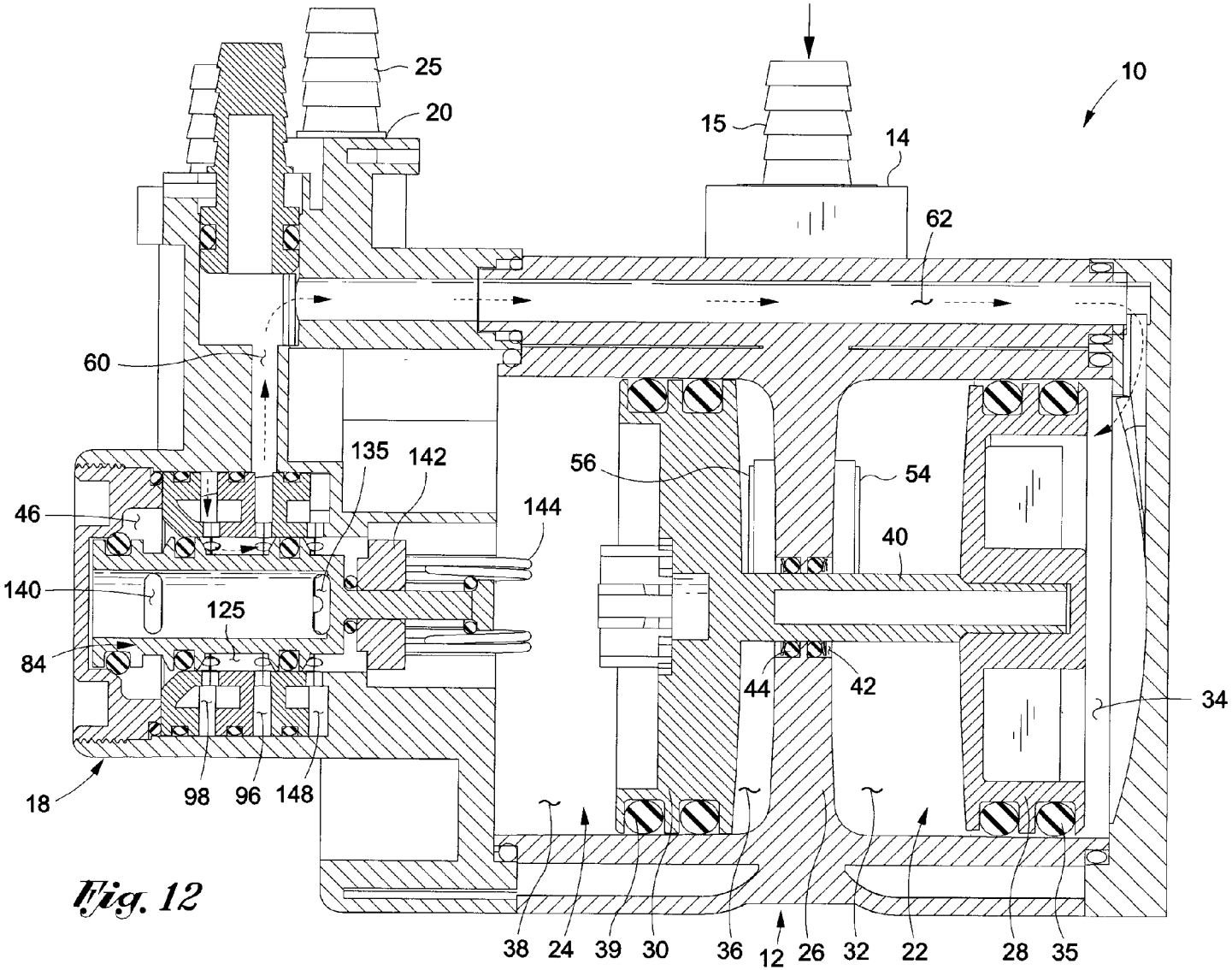
FIG. 12 is a side sectional view of the pressure intensifier with the pistons and valve member in a first position.

Referring now to FIG. 12, the piston heads 28, 30 are shown in the first piston position and the valve stem 84 is shown in a second stem position. In the first piston position, the first medial chamber 32 is in an expanded state and is filled with fluid from the first valve inlet 54. The first lateral chamber 34 is in a contracted state and is in fluid communication with the delivery passageway 62 to receive pressurized fluid therefrom. In the second stem position, the valve stem 84 is positioned relative the valve sleeve 82 to allow the first annular channel 96 to be in fluid communication with the second annular channel 98 via the fluid coupling segment 125.

Pressurized fluid is received from the pressurized fluid source via the inlet 14 and the pressurized fluid is diverted at the inlet junction 52 (see FIG. 2) such that a first portion of the pressurized fluid is communicated to the second inlet valve 56 to begin filling the second medial chamber 36 of the second pumping chamber 24. A second portion of the pressurized fluid is communicated to the internal valve chamber 46 via the valve inlet passageway 58 (see FIG. 2), which is in fluid communication with the second annular channel 98. When the valve stem 84 is in the second position, as shown in FIG. 12, the fluid coupling segment 125 fluidly connects the second annular channel 98 to the first annular channel 96 to allow the inlet fluid received in the second annular channel 98 to be communicated to the first annular channel 96 via the fluid coupling segment 125. The first annular channel 96 is in fluid communication with the first valve outlet 60 to receive the pressurized inlet fluid from the first annular channel 96 and to deliver the pressurized inlet fluid to the delivery passageway 62, which in turn, delivers the fluid to the first lateral chamber 34 of the first pumping chamber 22.

Therefore, while the first portion of the pressurized inlet fluid is directed into the second medial chamber 36 of the second pumping chamber 24, the second portion of the pressurized inlet fluid is directed into the first lateral chamber 34 of the first pumping chamber 22.

Figure 13:
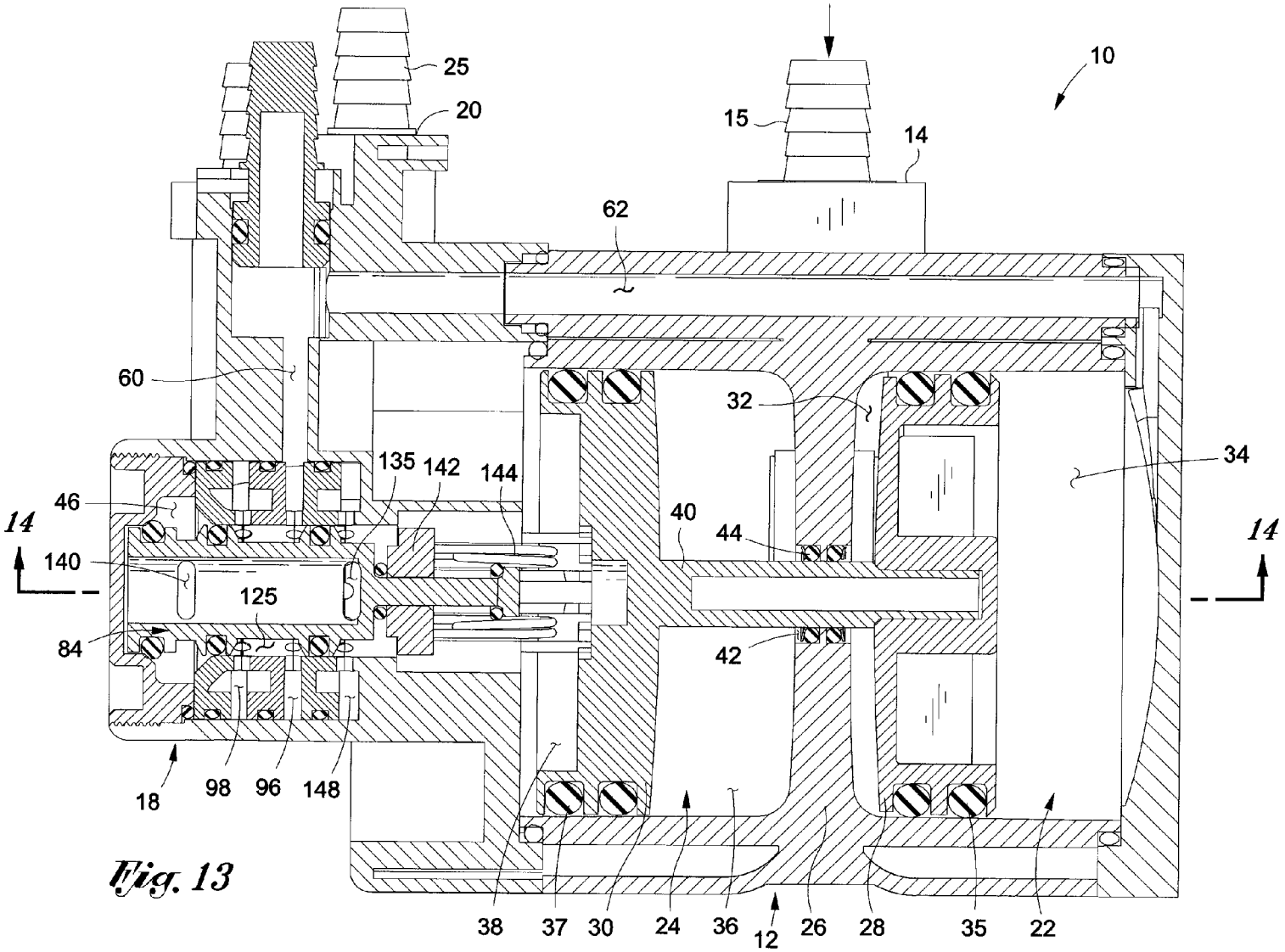
FIG. 13 is a side sectional view of the pressure intensifier with the pistons moved toward a second position and the valve member in the first position.

The second lateral chamber 38 of the second pumping chamber 24 and the first medial chamber 32 of the first pumping chamber 22 are filled with the fluid from a previous cycle. As the piston heads 28, 30 transition from the first piston position, as shown in FIG. 12, to the second piston position, as shown in FIG. 13, the pressure of the fluid contained within the first medial chamber 32 of the first pumping chamber 22 will be boosted and will exit the device 10 via the outlet 16. The boosted pressure is the result of the fluid force applied by the first piston head 28 on the fluid contained with the first medial chamber 32 of the first pumping chamber 22. The magnitude of that force is the combination of the pressure applied to the first piston head 28 by the pressurized fluid entering the first lateral chamber 34, and the pressure applied to the second piston head 30 via the pressurized fluid entering the second medial chamber 36. Since the pressure of the fluid entering the first lateral chamber 34 and the second medial chamber 36 is substantially equal to the inlet pressure of the fluid entering the inlet 14, the pressure of the fluid exiting the device 10 via the outlet 16 is substantially equal to twice the inlet pressure.

Furthermore, as the second piston head 30 travels from the first piston position toward the second piston position, the fluid in the second medial chamber 38 flows into an exhaust portion 148 of the valve chamber 46, which is in fluid communication with the valve exhaust passageway 75 (see FIG. 7) and ultimately the exhaust 20. Thus, fluid located in the second medial chamber 38 exits the device 10 via the exhaust 20 as the piston heads 28, 30 transition from the first piston position to the second piston position. The pressure of the fluid exiting via the exhaust 20 is minimal compared to the pressure of the fluid existing via the outlet 16.

FIG. 13 shows the piston heads 28, 30 in the second piston position and the valve stem 84 is in the second stem position. In the second piston position, the fluid in the first medial chamber 32 has been pumped through the outlet 16 and the first medial chamber 34 has been filed with pressurized fluid. The second medial chamber 36 is also filled with pressurized fluid and the fluid in the second lateral chamber 38 has been exhausted through the exhaust 20. At the completion of the transition from the first piston position to the second piston position, the valve stem 84 moves from the second stem position to the first stem position due to the interconnection of the valve stem 84 to the second piston head 30 via the slide body 142 and the springs 144, 146, as will be described in more detail below, and as shown in FIGS. 14 and 15.

Figure 14:
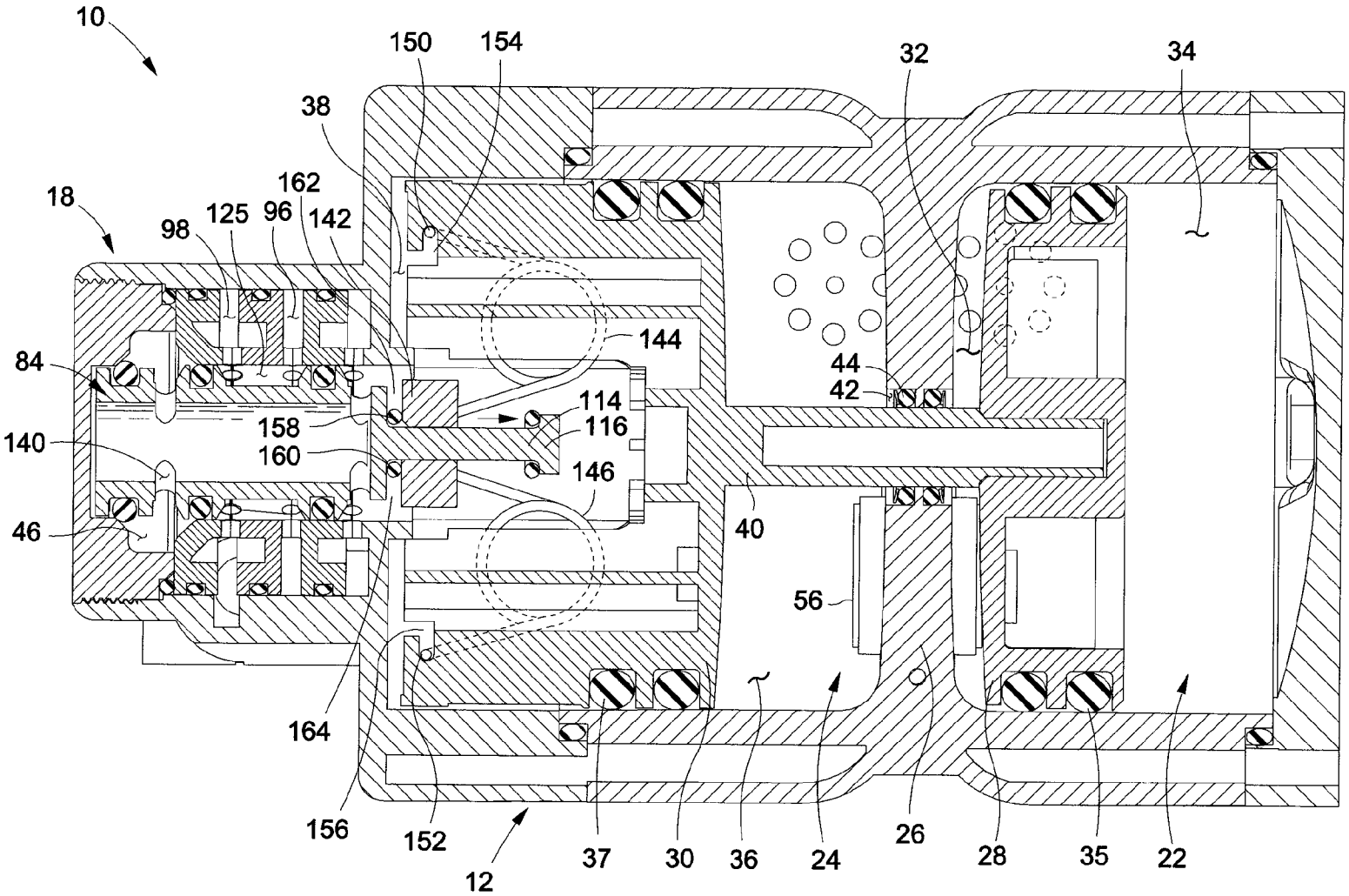
FIG. 14 is a bottom sectional view of the pressure intensifier depicted in FIG. 12.
Figure 15:
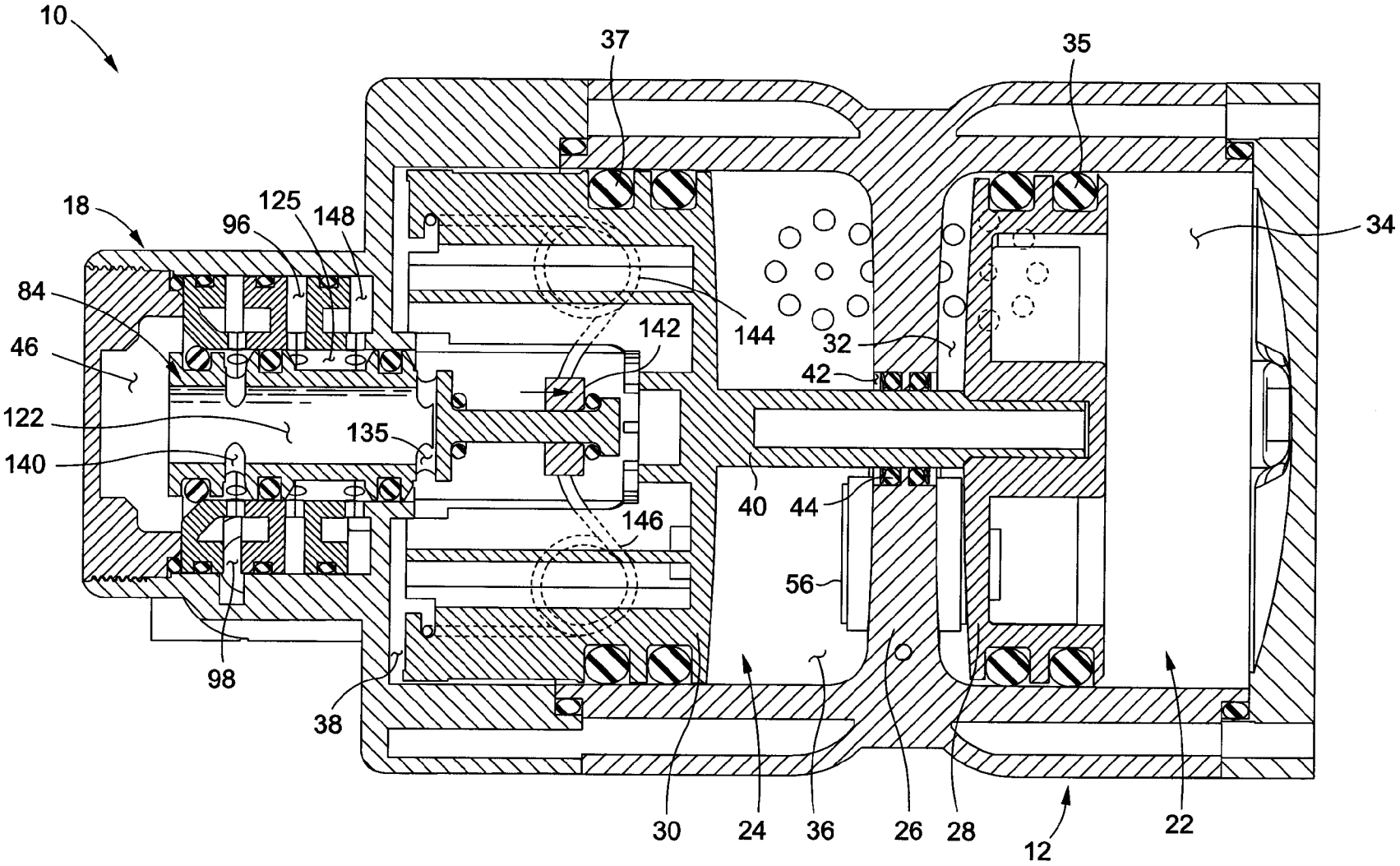
FIG. 15 is a bottom sectional view of the pressure intensifier with the pistons in the second position and the valve member in the first position.

FIG. 14 shows the piston heads 28, 30 and valve stem 84 in the same position as that shown in FIG. 13 (e.g., the piston heads 28, 30 in the second piston position and the valve stem 84 in the second stem position), although the cross section has been taken in a plane substantially orthogonal to the cross-sectional plane depicted in FIG. 13 in order to highlight movement of the spring elements 144, 146 and slide body 142 along the stem neck 114.

The spring elements 144, 146 include respective first end portions 150, 152 which are received within recesses 154, 156 formed within the second piston head 30 to couple the spring elements 144, 146 to the second piston head 130. The spring elements 144, 146 additionally include second end portions 158, 156 which are received within respective ones of the slots 162, 164 formed within the slide body 142. As the second piston head 30 moves between the first and second piston positions, the first end portions 150, 152 of the spring elements 144, 146 move with the second piston head 30. Likewise, as the slide body 142 moves along the stem neck 114, the second end portions 158, 160 move with the slide body 142.

When the second piston head 30 moves from the first piston position to the second piston position, the tension in the spring elements 144, 146 increases, and the orientation of the spring elements 144, 146 changes, such that when the second piston head 30 reaches the second piston position, the tension in the spring elements 144, 146 causes movement of the second end portions 158, 160 of the spring elements 144, 146 to release the tension. The movement of the second end portions 158, 160 causes the slide body 142 to translate along the stem neck 114. When the slide body 142 reaches the first end portion 116 of the stem neck 114, the movement of the slide body 142 urges the valve stem 84 to move from the second stem position (as shown in FIG. 14) to the first stem position (as shown in FIG. 15). When the valve stem 84 transitions from the first stem position to the second stem position, several fluid interconnections within the internal valve chamber 46 are modified.

FIG. 15 shows the valve stem 84 is in the first stem position. The second valve stem cutout 140 is aligned with the second annular channel 98, which receives pressurized fluid from the inlet 14. The pressurized fluid passes through the second stem valve cutout 140 and enters the inner stem opening 122. The fluid exits the inner stem opening 122 through the first stem valve cutout 135 and enters the second lateral chamber 38 of the second pumping chamber 24 such that the pressure of the fluid urges the second piston head 30 from the second piston position toward the first piston position.

When the valve stem 84 is in the first stem position and the piston heads 28, 30 are in the second piston position, the pressurized fluid received at the inlet 14 is divided into two portions, wherein the first portion is routed to the second lateral chamber 38 via the internal valve chamber 46, while the remaining portion of the pressurized fluid is routed to the first medial chamber 32 of the first pump chamber 22. The pressure of the fluid in the first medial chamber 32 and the second lateral chamber 38 urges the piston heads 28, 30 toward the first piston position, which compresses the fluid in the second medial chamber 36 and the first lateral chamber 34. The fluid in the second medial chamber 36 exits the device 10 via the outlet 16 at a pressure that is approximately equal to twice the inlet pressure.

The fluid that in the first lateral chamber 34 exits the first pump chamber 22 via the delivery passageway 62 (see FIG. 12) and enters the first annular channel 96 via the first valve outlet 60 (see FIG. 12). When the valve stem 84 is in the first stem position, the first annular channel 96 is fluidly coupled to the exhaust portion 148 via the fluid coupling segment 125. The exhaust portion 148 is coupled to the exhaust 20 to allow the fluid from the first lateral chamber 34 to exit the device 10 via the exhaust 20 at a minimal pressure.

When the piston heads 28, 30 reach the first piston position, the spring elements 144, 146 are flexed in a manner which causes the slide body 142 to slide from the first end portion 116 of the stem neck 114 toward the second end portion 116 of the stem neck 114, which in turn, urges the valve stem 84 toward the second stem position.

The piston heads 28, 30 and the valve stem 84 continually reciprocate between their respective first and second positions so long as pressurized fluid enters the intensifier 10. The intensifier 10 may be used to boost the outgoing fluid pressure by using the incoming fluid pressure. In this regard, the intensifier 10 does not require electricity, gas, or manual operation to boost the pressure, which reduces the cost when compared to conventional pumps, and operates cleaner because it does not release harmful emissions.

Figure 16:
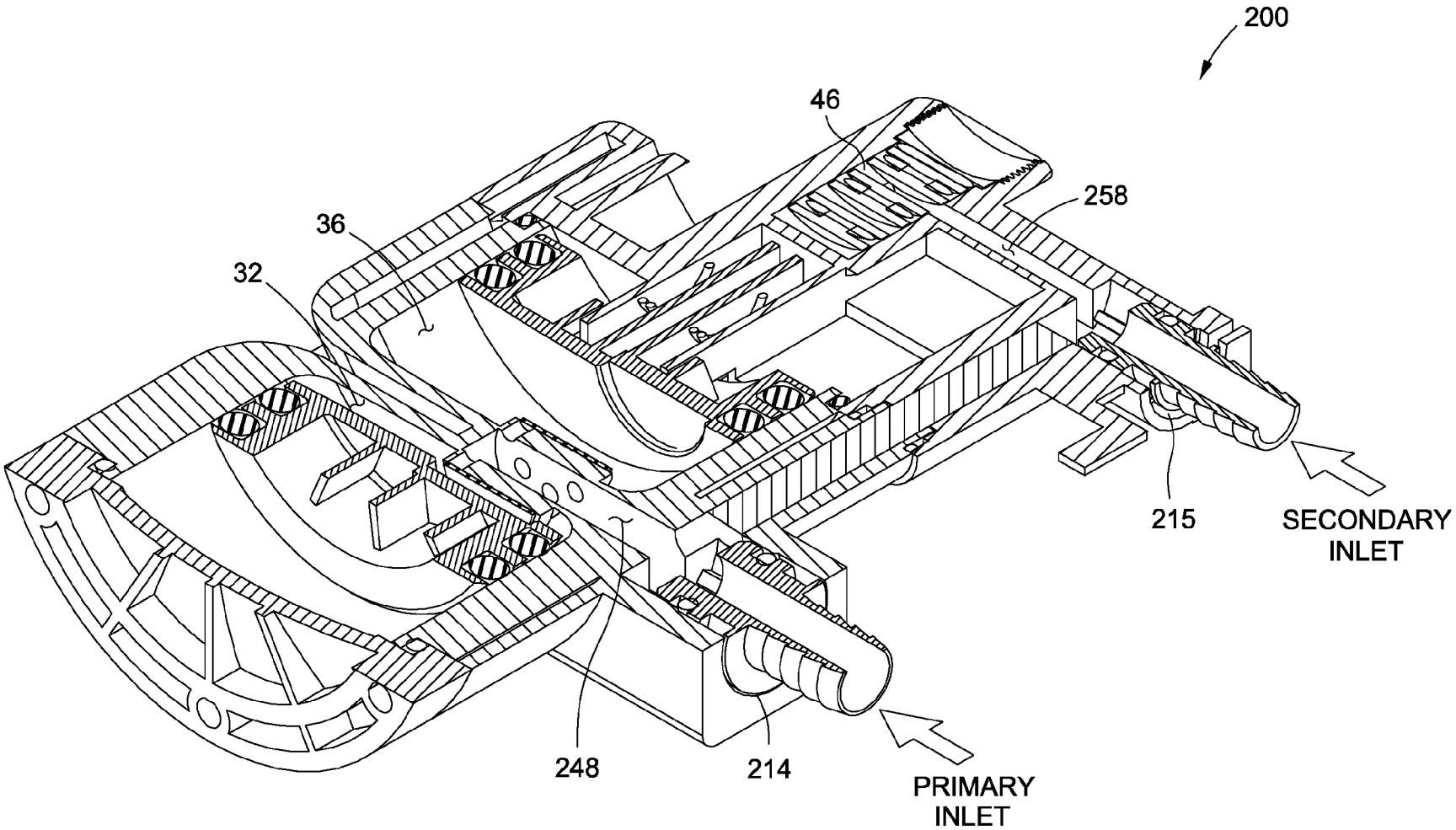
FIG. 16 is a perspective sectional view of a pressure intensifier constructed in accordance with another embodiment of the present invention.

Referring now to FIG. 16, there is shown another embodiment of a pressure intensifying device 200 which uses the pressure of a separate fluid for pressure boosting. In other words, a primary fluid is introduced into the device to have its pressure boosted, while a pressurized secondary fluid is introduced into the device to boost the pressure of the primary fluid.

The primary distinction between the embodiment depicted in FIG. 1-15 (the first embodiment) and the embodiment depicted in FIG. 16 (the second embodiment) is that the delivery passageway 62 included in the first embodiment is not included in the second embodiment. Furthermore, the second embodiment includes a secondary inlet that is not included in the first embodiment. Common reference numerals will be used on structural elements that are identical in the first and second embodiments, while new numbers will be assigned for structural elements that are unique to the second embodiment.

The second embodiment of the pressure intensifying device 200 includes a primary inlet 214 that is fluidly connectable to a primary fluid source to receive fluid therefrom. The primary inlet 214 communicates with a primary inlet passageway 248, which is in fluid communication with the first and second medial chambers 32, 36. All of the fluid from the primary inlet 214 is directed to one of the first and second medial chamber 32, 26, which is different from the first embodiment which included inlet junction 52 (see FIG. 2) for separating the inlet fluid into two separate portions. In this regard, all of the fluid received through the primary inlet 214 will have its pressure boosted through operation of the device. Along these lines, none of the fluid received by the primary inlet 214 will be used to boost the pressure.

The second embodiment further includes a secondary inlet 215 which is fluidly connectable to a secondary fluid source to receive pressurized fluid therefrom. The pressurized fluid received via the secondary inlet 215 is used to boost the pressure of the fluid received through the primary inlet 214. The secondary inlet 215 communicates with a valve inlet passageway 258 to deliver the fluid to the inner valve chamber 46.

Therefore, while the first embodiment includes a single inlet and separates the inlet fluid into two separate components to deliver fluid to the medial chambers 32, 36 and the valve chamber 46, the second embodiment uniquely includes two separate inlets, wherein one inlet 214 delivers fluid to the medial chambers 32, 36 and the second inlet 215 delivers fluid to the valve chamber 46. The valve and piston operation in the second embodiment is similar to the valve and piston operation described above in relation to the first embodiment, and thus reference is made to the foregoing description of the structure and operation of the valves and pistons.

The second embodiment may be desirable for reverse osmosis applications, wherein pressurized waste water from reverse osmosis systems is introduced into the secondary inlet to boost the pressure of fluid received via the primary inlet. The second embodiment may also be used with a municipal water line fluidly connected to the secondary inlet to use the pressure from the municipal water line to boost the pressure of fluid in the medial chambers 32, 36. For instance, the water may be used to pressurize air in the medial chambers 32, 36.

As used herein, the word "fluid" is used to refer to a liquid or a gas. Thus, the first and second embodiments may be used with both liquids and gases.

Additional modifications and improvements of the present invention may also be apparent to those of ordinary skill in the art. Thus, the particular combination of components and steps described and illustrated herein is intended to represent only certain embodiments of the present invention, and is not intended to serve as limitations of alternative devices and methods within the spirit and scope of the invention.

What is claimed is:

1. A fluid pressure intensifier configured for use with a pressurized fluid source, the fluid pressure intensifier comprising:

a primary housing including:

a first chamber;

a second chamber;

an inlet formed on the primary housing and dividing within the primary housing to form at least a portion of a primary inlet passageway and a secondary inlet passageway, the primary inlet passageway extending between the inlet and the first and second chambers;

an outlet;

an exhaust;

and an outlet passageway extending between the outlet and the first and second pump chambers;

first and second pistons heads coupled to each other and disposed within and moveable within respective ones of the first and second chambers, the first piston head dividing the first chamber into a first medial chamber and a first lateral chamber, the second piston head dividing the second chamber into a second medial chamber and a second lateral chamber;

a valve housing coupled to the primary housing, the valve housing having an inner valve chamber fluidly coupled to the inlet via the secondary inlet passageway, and the first and second lateral chambers such that fluid entering the first and second lateral chambers flows through the inlet and the inner valve chamber;

a valve member disposed within the inner valve chamber and transitional relative to the valve housing between a first position and a second position;

in the first position the inlet is in fluid communication with the first lateral chamber via the inner valve chamber and the secondary inlet passageway, the first medial chamber is in fluid communication with the outlet via the outlet passageway, the second medial chamber is in fluid communication with the inlet via the primary inlet passageway, and the exhaust is in fluid communication with the second lateral chamber via the inner valve chamber;

in the second position, the inlet is in fluid communication with the second lateral chamber via the inner valve chamber and the secondary inlet passageway, the second medial chamber is in fluid communication with the outlet via the outlet passageway, the first medial chamber is in fluid communication with the inlet via the primary inlet passageway, and the exhaust is in fluid communication with the first lateral chamber via the inner valve chamber.

2. The fluid pressure intensifier recited in claim 1, wherein the valve member includes a valve sleeve and a valve stem coaxially aligned with the valve sleeve and moveable relative thereto between a first stem position and a second stem position.

3. The fluid pressure intensifier recited in claim 2, further comprising an over-center linkage coupled to the second piston head and the valve stem to correlate movement of the valve stem to movement of the piston heads.

4. The fluid pressure intensifier recited in claim 3, wherein the over-center linkage includes a slide body translatably coupled to the valve stem and a spring element coupled to the second piston head.

5. The fluid pressure intensifier recited in claim 2, wherein the valve member includes:

an inner cylindrical portion defining an inner opening sized to receive the valve stem; and a plurality of annular ribs coupled to and extending radially outward from the inner cylindrical portion.

6. The fluid pressure intensifier recited in claim 5, wherein the plurality of annular ribs define a plurality of channels between adjacent ones of the plurality of rib, at least one of the channels being in fluid communication with the secondary inlet passageway and an exhaust passageway.

7. The fluid pressure intensifier recited in claim 6, wherein the valve sleeve and the valve stem collectively define a fluid connection passageway which moves relative to the valve housing as the valve sleeve moves between the first and second stem positions, when the valve stem is in the first stem position, the fluid connection passageway is in fluid communication with the first medial chamber and the exhaust, when the valve stem is in the second stem position, the fluid connection passageway is in fluid communication with the inlet and the first medial chamber.

8. The fluid pressure intensifier recited in claim 7, wherein when the valve stem is in the first stem position, the fluid connection passageway is fluidly isolated from the inlet, and when the valve stem is in the second stem position, the fluid connection passageway is fluidly isolated from the exhaust.

9. The fluid pressure intensifier recited in claim 1, wherein the primary housing includes an intermediate wall separating the first chamber from the second chamber, the intermediate wall including an aperture formed therein, the fluid pressure intensifier further including:

a connecting rod extending through the aperture in the intermediate wall and connected to the first and second piston heads on opposed end portions thereof.

10. A pressure intensifier for use with a pressurized fluid source, the pressure intensifier comprising:

a main body having a valve chamber, and first and second piston chambers disposed therein;

an inlet formed on the main body and dividing within the main body to form a first inlet passageway and a second inlet passageway;

first and second interconnected piston heads disposed within respective ones of the first and second piston chambers, the first piston head dividing the first piston chamber into primary and secondary portions, the second piston head dividing the second piston chamber into primary and secondary portions, the first and second pistons heads being moveable relative to the main body between first and second piston positions;

an inlet valve connected to the main body and fluidly connectable with the pressurized fluid source via the first inlet passageway and transitional between first and second inlet configurations for alternately pressurizing the primary portions of the first and second piston chambers with fluid from the pressurized fluid source;

a primary valve member connected to the main body and residing within the valve chamber, fluidly connectable with the pressurized fluid source via the second inlet passageway and moveable relative to the main body between first and second valve positions for alternately pressurizing one of the secondary portions of the first and second piston chambers with fluid from the pressurized fluid source such that fluid entering the secondary portions of the first and second piston chambers flows through the valve chamber, and venting fluid from the other one of the secondary portions of the first and second piston chambers; and an outlet valve coupled to the main body and moveable between first and second outlet configurations for alternately venting fluid from the primary portions of the first and second piston chambers;

wherein when the first and second piston heads are in the first position, the inlet valve is in the first inlet configuration to allow fluid to flow into the primary portion of the first piston chamber with fluid from the pressurized fluid source, the primary valve member is in the first position to vent fluid from the secondary portion of the first piston chamber and to direct fluid into the secondary portion of the second piston chamber, and the outlet valve is in the first outlet configuration to vent fluid from the primary portion of the second piston chamber;

wherein when the first and second piston heads are in the second position, the inlet valve is in the second inlet configuration to allow fluid to flow into the primary portion of the second piston chamber with fluid from the pressurized fluid source, the primary valve member is in the second position to vent fluid from the secondary portion of the second piston chamber and to direct fluid from the pressurized fluid source into the secondary portion of the first piston chamber, and the outlet valve is in the second outlet configuration to vent fluid from the primary portion of the first piston chamber.

11. The pressure intensifier recited in claim 10, further comprising an over-center linkage coupled to the primary valve member and for moving the primary valve member between the first and second valve positions in response to movement of the first and second pistons.

12. A fluid pressure intensifier comprising:

a housing having:

an inlet;

an outlet;

an exhaust;

a valve chamber fluidly connected to the inlet, the outlet, and the exhaust;

first and second piston chambers each being fluidly connectable to the inlet, the outlet and the exhaust; and a flowpath within the housing extending from the inlet and dividing within the housing to form first and second fluid passageways, the first fluid passageway extending from the inlet to the first and second piston chambers, and the second fluid passageway extending from the inlet toward the valve chamber;

a first piston head and a second piston head coupled to each other and disposed within respective ones of the first and second piston chambers and moveable relative to the housing between a first piston position and a second piston position, the first piston head dividing the first piston chamber into a first medial chamber and a first lateral chamber, the second piston head dividing the second piston chamber into a second medial chamber and a second lateral chamber;

and a valve member coupled to the housing, residing in the valve chamber, and fluidly connected to the inlet, the outlet and the exhaust, the valve member being moveable relative to the housing between a first valve position and a second valve position;

in the first valve position, the inlet is fluidly connected to the second lateral chamber via the valve chamber and the first lateral chamber is fluidly connected to the exhaust via the valve chamber, the inlet is fluidly connected to the first medial chamber and the second medial chamber is fluidly connected to the outlet;

in the second valve position, the inlet is fluidly connected to the first lateral chamber via the valve chamber and the second lateral chamber is fluidly connected to the exhaust via the valve chamber, the inlet is fluidly connected to the second medial chamber and the first medial chamber is fluidly connected to the outlet;

the housing being configured such that fluid flows through the valve chamber before flowing into either one of the first lateral chamber and the second lateral chamber.

13. The fluid pressure intensifier recited in claim 12, wherein the valve member includes a valve sleeve and a valve stem coaxially aligned with the valve sleeve and moveable relative thereto between a first stem position and a second stem position.

14. The fluid pressure intensifier recited in claim 13, further comprising an over-center linkage coupled to the second piston head and the valve stem to correlate movement of the valve stem to movement of the piston heads.

15. The fluid pressure intensifier recited in claim 14, wherein the over-center linkage includes a slide body translatably coupled to the valve stem and a spring element coupled to the second head.

16. The fluid pressure intensifier recited in claim 13, wherein the valve member includes:

an inner cylindrical portion defining an inner opening sized to receive the valve stem; and a plurality of annular ribs coupled to and extending radially outward from the inner cylindrical portion.

17. The fluid pressure intensifier recited in claim 16, wherein the plurality of annular ribs define a plurality channels between adjacent ones of the plurality of rib, at least one of the channels being in fluid communication with the secondary inlet passageway and an exhaust passageway.

18. The fluid pressure intensifier recited in claim 17, wherein the valve sleeve and the valve stem collectively define a fluid connection passageway which moves relative to the valve housing as the valve sleeve moves between the first and second stem positions, when the valve stem is in the first stem position, the fluid connection passageway is in fluid communication with the first medial chamber and the exhaust, when the valve stem is in the second stem position, the fluid connection passageway is in fluid communication with the inlet and the first medial chamber.

19. The fluid pressure intensifier recited in claim 18, wherein when the valve stem is in the first stem position, the fluid connection passageway is fluidly isolated from the inlet, and when the valve stem is in the second stem position, the fluid connection passageway is fluidly isolated from the exhaust.

20. The fluid pressure intensifier recited in claim 12, wherein the primary housing includes an intermediate wall separating the first chamber from the second chamber, the intermediate wall including an aperture formed therein, the fluid pressure intensifier further including:

a connecting rod extending through the aperture in the intermediate wall and connected to the first and second piston heads on opposed end portions thereof.

* * * * *